United States Patent [19]

Szabo

[11] 4,008,480

[45] Feb. 15, 1977

[54] PHOTOCOMPOSITION ESCAPEMENT DRIVE SYSTEM

[75] Inventor: Francis S. Szabo, Morristown, N.J.

[73] Assignee: Addressograph Multigraph Corporation, Cleveland, Ohio

[22] Filed: June 16, 1975

[21] Appl. No.: 586,922

[52] U.S. Cl. ..... 354/5

[51] Int. Cl.[2] ..... B41B 13/10

[58] Field of Search ..... 354/5, 8, 9, 10, 15; 355/56, 57; 74/89.2, 89.21, 89.22, 128, 1.5

[56] References Cited

UNITED STATES PATENTS

| | | | |
|---|---|---|---|
| 2,670,665 | 3/1954 | Caldwell | 354/13 |
| 3,118,354 | 1/1964 | O'Brien | 354/12 |
| 3,537,365 | 11/1970 | Schumann | 354/15 |
| 3,909,832 | 9/1975 | Booth | 354/5 |
| 3,914,774 | 10/1975 | Griffith | 354/5 |

*Primary Examiner*—L. T. Hix
*Assistant Examiner*—Alan Mathews
*Attorney, Agent, or Firm*—Ray S. Pyle

[57] ABSTRACT

The use of a stepper motor of large steps, with a pulley type mechanical motion reducer system using a flexible cable for dividing a step of the motor into a divided output motion, and an alternative embodiment wherein a second stepper motor in the form of a two-step solenoid further alters the output by changing the position of the flexible cable anchor. The combination is illustrated in an environment of a lens in a photocomposer wherein a carriage carries a decollimating focusing lens and mirror as an escapement composition device shifted in accordance with the dictates of a program operating under specific algorithms.

4 Claims, 5 Drawing Figures

PHOTOCOMPOSITION ESCAPEMENT DRIVE SYSTEM

RELATED INVENTIONS

This invention is an alternative approach to application Ser. No. 568,566 filed Apr. 16, 1975, by George G. Pick entitled COARSE/FINE STEPPING MOTOR FOR PHOTOTYPESETTERS.

BACKGROUND OF THE INVENTION

This invention relates to photographic composing apparatus, and more particularly to apparatus for projecting the selected characters upon a sensitized material.

A necessary function of such apparatus is to cause relative motion between the projected character images and the sensitized surface. This motion usually depends upon the widths of the characters and upon the increments to be added between words and characters to justify the line. This motion must also be performed with speed and precision commensurate with the desired accuracy in the alignment of character projections.

Early in the development of photocomposition, the optical system used for character projection was held stationary, and the carriage on which the sensitized material is mounted was moved at discreet times, both to bring about spacing between successive projected characters and words, and to bring about spacing between successive lines, or line spacing.

Thereafter, U.S. Pat. No. 2,670,665 which issued Mar. 2, 1954, proposed a very practical character spacing arrangement wherein the character was caused to become collimated and then refocused by a decollimator which was positioned in the proper relationship to a sensitized sheet for producing the necessary spacing with respect to the prior character.

However, the development of character escapement thereafter appears to have abandoned the collimating teaching of U.S. Pat. No. 2,670,665 and taken the form of optical leverage devices. In optical leverage concepts, the rotating font and the sensitized sheet were both held stationary, and the image projection angle changed, or wherein the entire drive motor and rotating character font is stepped along relative to the sensitized sheet. Many proposals have been made, which include roof mirrors or prisms to pick an image from the disc font and space the resultant projection along the paper, and intercepting mirrors which are rotated in proper sequence to reflect the image. The proposal by U.S. Pat. No. 2,670,665 appears to have been abandoned for reasons unknown. The provisions of this invention may be the clue overlooked which enables the basic teaching of U.S. Pat. No. 2,670,665 to be of greater simplicity and more practical than many of the developments of that which came after the proposals of U.S. Pat. No. 2,670,665.

DESCRIPTION OF THE PREFERRED EMBODIMENT

Figure 1:
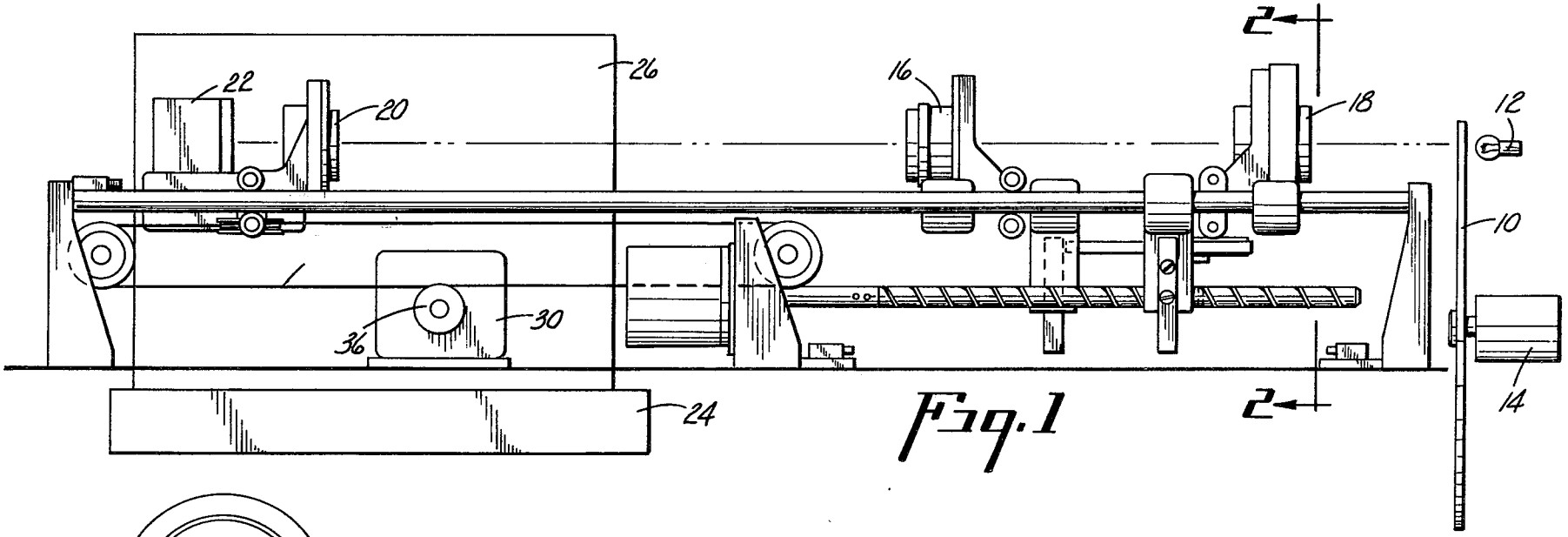
FIG. 1 is a side elevational view of the mechanical lens positioning system of a photocomposition machine, with the font source and flash system shown schematically.

A complete description of the construction and operation of a photocomposition machine as shown in FIG. 1 may be had by reference to application Ser. No. 576,382 filed May 12, 1975, by George G. Pick and Francis S. Szabo entitled PHOTOCOMPOSITION MACHINE. However, the present invention does not depend upon a full understanding of a complete machine embodying the elements illustrated.

The essential elements of photocomposition shown in FIG. 1 comprise a disc 10 which is a rotating font source as now wellknown and widely used in the photocomposition industry. A flash illumination, illustrated symbolically by the bulb 12, provides the projection illumination of a selected character. This disc is rotated at high speed by a motor 14.

The environment chosen to illustrate this invention comprises generally a collimating lens 16 to pick up the image, project the image as a column of light, where it is decollimated by a converging lens 20 and reflected by a mirror 22 onto a photographic sensitive paper 26.

As an added feature available in the newest of photocomposition machines, a variator lens 18 may be employed for putting in the focal plane of the collimating lens an image of the character to be projected. Otherwise, the lens 16 would be placed a fixed distance from the disc 10 and would produce one fixed point size image. By providing the variator lens 18, a variable size aerial image may be provided to the collimating lens 16, and therefore point size changed without changing lenses. However, this invention does not depend upon the refinement of the particular lens grouping described, but rather this background is provided for illustrating one commercial environment in which the invention is operative.

In the composition of text for printing, it is desirable to space the letters of the words in a line for pleasing optical effect, and to end each line at exactly the same distance from the starting border of the text. This is known as justification. All typesetting characters occupy a specific amount of space. Vertically that space is called point size but horizontally it is called set width. With certain character combinations, such as an upper case "W" and a lower case "e" to spell the word "We", the ordinary typewriter escapement spacing places an unpleasant gap between the characters. For better-looking type, characters should be tucked together; i.e., the spacing reduced. This function is called kerning or sometimes mortising. In kerning some of the character width of the character before the next one is subtracted.

Then, for justification of a line it is necessary to increase the space between words in order to spread the amount of extra space that would ordinarily appear at the end of a line into those spaces throughout the line for better appearance.

These spacing problems and their solutions were not possible on a typewriter, and were solved by the use of a manual strike-on typewriter using a mechanical memory. The most successful of such machines was sold under the VariTyper trademark and was the forerunner of modern phototypesetting.

In phototypesetting, the same problems occur and the same solutions are used with respect to spacing of the letters. However, the spacing of the letters and the provision of extra spaces between words is done by projecting the image of a letter rather than the hardware which strikes the paper sheet. In order to accomplish kerning as well as word spacing and letter spacing for the difference between wide letters and narrow letters, a very fine escapement capability is required. Because phototypesetting machines are operated by electrically driven prime mover devices, the logical solution is a stepper motor which can be programmed to step the precise number of units from a given starting point according to a controller program for the machine.

Stepper motors may be obtained with step divisions of any magnitude within wide ranges. However, the smaller the step division the greater is the price of building the machine and the cost of operation. The smaller step machines are slower and produce much more heat. Hence, it is desirable to use a stepper motor with as large a step as possible.

The contrary objectives of very small spacing to obtain the best possible composition, over and against the desired lower cost, low power consumption and speedy large step motors is therefore apparent. This invention provides a unique solution to that dilemma wherein a large step motor will provide the fine divisions which are so desirable. This invention employs a stepper motor 30 to operate the mechanical motion reduction system 32. System 32 is very similar to a double acting block and tackle construction known in the mechanical arts as a pulley system.

Each of the systems employs a flexible line 34 which is secured to a drive spool 36 mounted on and driven by the output shaft of the motor 30. Referring to one of the systems only, because they are identical, the line 34 is then reeved around a pulley 38 which pulley may be considered to be a stationary position turning surface. It is better that the surface be a rotatable pulley to eliminate sliding friction drag. The carriage for the decollimating or converging lens 20 has mounted on the bottom thereof a rotatable pulley 40 and line 34, after looping around the pulley 38, is directed around the pulley 40 and back to a fixed anchoring point 42 on the frame of the machine.

Figure 3:
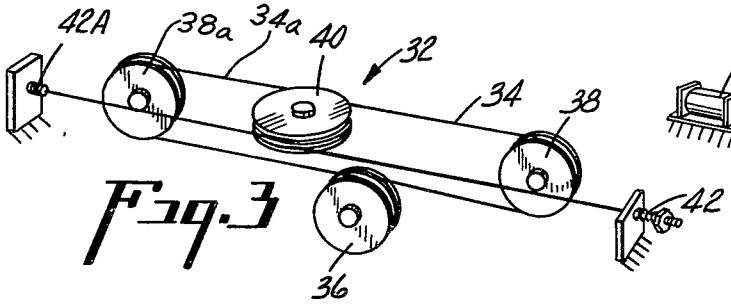
FIG. 3 is a perspective illustration of the basic mechanical motion reducer system.
Figure 5:
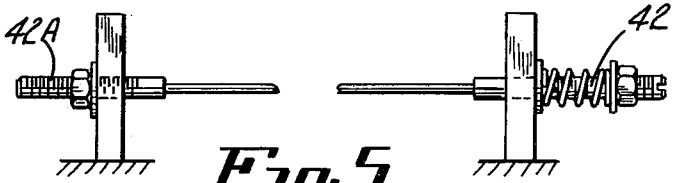
FIG. 5 is a detail of the line adjustment construction.
Figure 2:
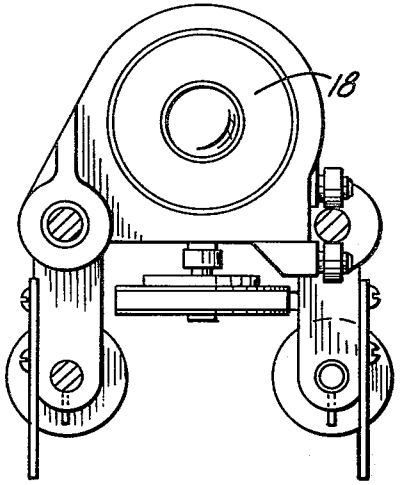
FIG. 2 is a section view taken along the line 2—2 of FIG. 1.

Assume at this point that there is a force tending to move the carriage for the lens 20 in the direction of pulley 38A in FIG. 3. Then, as the motor turns the spool 36 to take up the line 34, the mechanical nature of the system will cause the pulley 40 and hence the carriage for lens 20 to move toward the fixed position pulley 38, but the line 34 will remain tight.

Then, by wrapping the counterpart line 34A around the pulley 36 in the opposite direction from the line 34, and threading the line about the fixed position pulley 38A, the second guide groove on the pulley 40 and back to ground position 42A, it will be seen that as the spool 36 takes up on line 34 it lets out on line 34A, and the system is balanced. When the motor reverses the opposite is true, and the line 34A will be taken up and the line 34 will be played out. As a result, an exact movement of the pulley 40 is achieved, but due to the mechanical advantage nature of the pulley system construction, the movement of the pulley 40 is only half of the movement of the pulley 36. This is a known mechanical phenomenon.

In order to operate the system successfully, one of the anchors 42 or 42A is a tightening anchor bolt and the other is resilient in nature in order to keep the lines 34 and 34A taut at all times. Thus, the stepper motor 30 is able to operate in steps twice that of the desired escapement steps of the machine and the economies of the larger step motor with less power input are achieved in a deceptively simple construction.

There are known prior devices which produce digital output by a series of solenoid operated line deflectors, the sum of the deflection of which will cause the output of the deflected line to move according to the deflectors which have been actuated. However that structure must not be confused with the rapidly operable system described. Such a digital operation is conceivable for achieving escapement, but the principle of operation is considerably diverse from the teaching thus far given herein.

Figure 4:
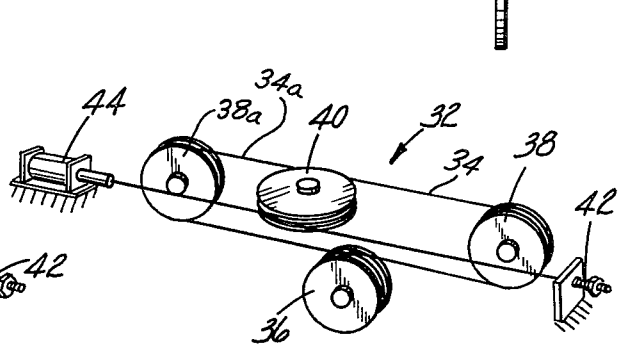
FIG. 4 is a modified mechanical motion reducer system.

The discussion with respect to FIG. 3 has shown how to achieve a division by two in order to enable a larger stepper motor to achieve small steps, and reference to FIG. 4 will show a construction which will enable a motor of a magnitude of four times the desired output to be utilized. This is achieved by provision of a two-step stepper motor, which is actually a bistable solenoid 44 acting as the mount for one of the flexible lines 34. Then, by the provision of a flexible mount at the end of the counterpart line, the starting position of the system is alterable into relative positions, and then the effect is to divide the steps of the motor by four. The FIG. 4 configuration therefore provides a greatly reduced cost of construction and operation with a fineness of positioning formerly thought available only in the expensive small-step stepper motor.

What is claimed is:

1. A photographic type composing apparatus having a collimating lens, means for putting in the focal plane of the collimating lens an image of the character to be projected, an illuminating device to project the images of selected characters forming a line successively through the collimating lens, each character having a predetermined width value and being projected while it is in the projection position, a translating lens combination including a converging lens and a reflector arranged one behind the other to focus the projected light and reflect it through a predetermined angle, a support to hold a sensitized surface in substantial coincidence with the focal plane of the light leaving the lens combination, characterized by an improved means for displacing the lens combination relative to the collimating lens and longitudinally of the surface after each projection by variable distances proportional to the widths of the corresponding characters, comprising, a stepper motor primary drive means, and a mechanical motion reducer system means for dividing a step of said motor into a reduced output motion, wherein the stepper motor has a step movement at least twice the required step size to position the lens combination at all possible required distances and wherein the mechanical motion reducer system is a flexible line driven by a line spool carried by the motor, and the line is reeved around a stationary position turning surface, a similar turning surface carried by the carriage, and extends back toward the stationary turning surface to a anchor point in a block and tackle configuration to reduce the motor output at least by half the length of line taken up in one motor step.

2. The flexible line and block and tackle configuration of claim 1, wherein identical systems drive the lens combination in opposite directions, and the two systems are each separately carried on the spool of the drive motor, one of which is being wound upon the spool while the other is relieved from the spool.

3. The mechanical motion reducer system of claim 1 wherein the anchor for the end of the flexible cable is a two-position solenoid stepper motor, whereby the output from the stepper motor primary drive may be divided by four using the combination of block and tackle plus further positioning the end of the flexible cable in two different selected locations.

4. A drive system for the escapement carriage of a photocomposition machine, comprising:

a primary drive stepper motor;

a line spool driven by said motor, a flexible line attached to said spool, said line being taken up or played out in response to the directions of spool rotation;

a stationary pulley, an escapement carriage a pulley carried by the escapement carriage, and said line reeved around said pulleys and being attached at one end to a fixed anchor point whereby, the escapement carriage is moved a distance half the length of line taken up by the line spool.

* * * * *